United States Patent [19]

Wightman

[11] 4,453,592

[45] Jun. 12, 1984

[54] EXPANSION GUIDE

[75] Inventor: James D. Wightman, Wellsville, N.Y.

[73] Assignee: The Air Preheater Company, Inc., Wellsville, N.Y.

[21] Appl. No.: 289,616

[22] Filed: Aug. 3, 1981

[51] Int. Cl.[3] ..... F28F 9/26

[52] U.S. Cl. ..... 165/82; 165/78; 165/83; 165/145; 165/176

[58] Field of Search ..... 165/78, 81–83, 165/145, 176, DIG. 28

[56] References Cited

U.S. PATENT DOCUMENTS

| | | | |
|---|---|---|---|
| 2,487,626 | 11/1949 | Wittman | 165/82 |
| 2,653,799 | 9/1953 | Stahn et al. | 165/83 |
| 3,305,008 | 2/1967 | Jacobs | 165/145 |
| 4,202,407 | 5/1980 | Woitowitz | 165/176 X |

*Primary Examiner*—Sheldon J. Richter

*Attorney, Agent, or Firm*—William W. Habelt; Wayne H. Lang

[57] ABSTRACT

A multiple module heat exchanger having a serpentine path for one fluid to flow transversely through adjacent modules while a second fluid flows longitudinally therethrough. A guide pin carried by one module and a mating receptacle carried by a module adjacent thereto cooperate to permit relative longitudinal movement between modules while precluding relative transverse movement therebetween. The mating guide pin and receptacle are located at the central axis of adjacent modules whereby there may be a limited amount of pivotal movement between adjacent modules.

4 Claims, 3 Drawing Figures

EXPANSION GUIDE

BACKGROUND OF THE INVENTION

This invention relates to a recuperative heat exchanger that is comprised of independent modules lying in juxtaposition and enclosed in an integral housing. A heating fluid is directed axially through adjacent modules between aligned inlet and outlet ports, while a fluid to be heated is directed over a serpentine flow path between laterally adjacent inlet and outlet ports at a single side of the housing.

Presently used apparatus of this type fixedly connects adjacent modules together into a structurally integral unit. When adjacent modules are connected together and exposed to different temperatures, differential expansion of the several modules forces them to expand away from a fixed connection causing excessive offset of modules and excessive stresses in any connection or expansion joint positioned between each module and the surrounding housing. Moreover, such excessive expansion may cause a cracking of the connection between adjacent modules and excessive leakage therefrom to significantly lower the operating effectiveness of the heat exchanger.

DESCRIPTION OF THE PRIOR ART

U.S. Pat. No. 2,653,799 shows a somewhat similar arrangement wherein a recuperative heat exchanger is enclosed in a housing that directs a first fluid over a second fluid being directed through the recuperative elements of the heat exchanger. Although the recuperative elements are flexibly connected to the housing by means of a bellows type joint, the separate elements are firmly connected one to another. Thus a variation of temperature would cause uneven expansion and probable breakage of the connection between separate elements, while a general increase of temperature might cause the elements to buckle, bend or otherwise become thermally distorted.

U.S. Pat. No. 2,487,626 shows an arrangement whereby the independent tubes in a heat exchanger are permitted to expand without disturbing the other parts of the heat exchanger. It is noted, however, that the individual tube sheets thereof are bolted to one another whereby any relative movement would effect breakage of the connection therebetween and eventual leakage of fluid from within the heat exchanger.

SUMMARY OF THE INVENTION

This invention is therefore directed to a recuperative heat exchanger comprised of adjacent modules that are adapted to thermally expand or contract independently without destroying the integrity of the heat exchanger. More specifically, this invention provides a modular heat exchanger having a serrpentine flow path wherein each module thereof is flexibly connected to a surrounding housing while being flexibly connected to module adjacent thereto by means of a slip type connection. Moreover, a clearance space is provided between adjacent modules whereby adjacent modules may be subjected to limited pivotal movement and distortion without causing misalignment or destroying the integrity of the heat exchanger.

DESCRIPTION OF THE PREFERRED EMBODIMENT

Figure 1:
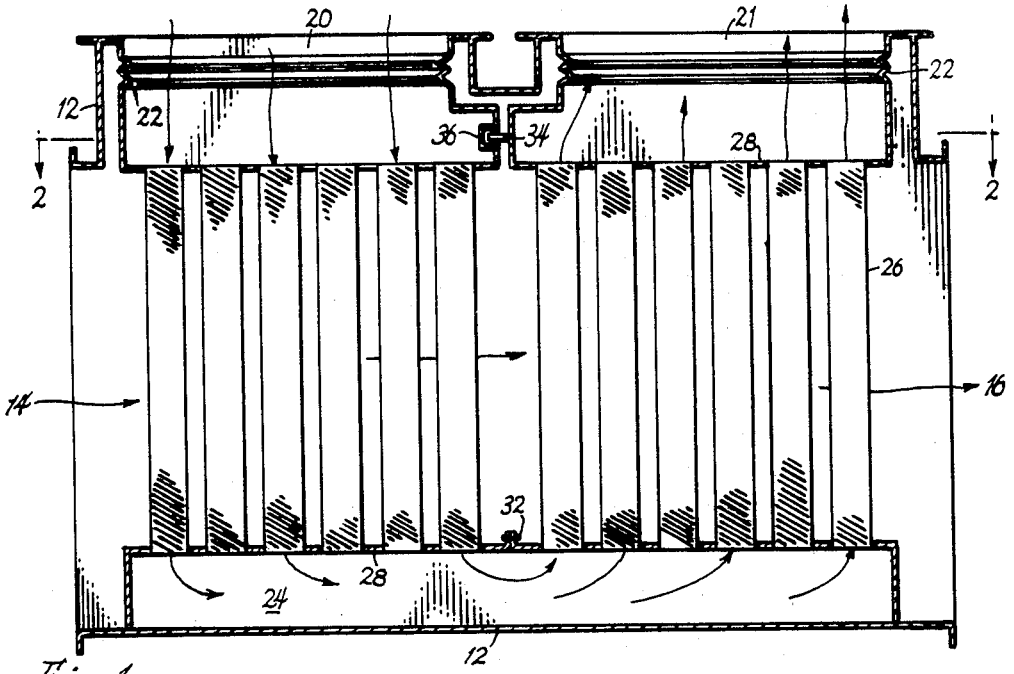
FIG. 1 of the drawing is a sectional side elevation of a modular heat exchanger including a guide means according to this invention, FIG. 2 of the drawing is a cross-sectional view as seen from line 2—2 of FIG. 1, and FIG. 3 of the drawing is an enlarged top view of the guide means as seen from line 3—3 of FIG. 2.

In the invention a heat exchanger includes a housing 12 that has an inlet 14 at one end and an outlet 16 at the other whereby it may be interposed in a conduit conducting hot exhaust gases therethrough. Independent heat exchange modules are disposed in the housing across the stream of hot exhaust gases to transfer the heat thereof to a cooling fluid that flows through port 20, makes a U-turn and exhausts through outlet port 21. The modules each are connected to one wall of the housing around inlet and outlet ports 20–21 by a flexible joint such as bellows 22, while a tube sheet 28 at the opposite end of each module is rigidly secured to housing 12 in spaced relation to form a header 24 or common enclosure for adjacent module ends thus providing a "U-shaped" flow path through the heat exchanger for a cooling fluid to enter inlet port 20 and exhaust through outlet port 21.

Each module comprises a plurality of tube-like elements 26 arranged in parallel, spaced relationship between aligned apertures of tube sheets 28. The tubes are rigidly connected to both tube sheets, while tube sheets at one end of the heat exchanger are connected rigidly together at 32, and at the opposite end thereof they are independently attached by their respective bellows 22 to the housing around aligned ports 20–21.

In accordance with this invention I provide a pin 34 that is firmly secured to one module and adapted to extend horizontally toward a longitudinally adjacent module. The longitudinally adjacent module carries a recessed receptacle 36 that is adapted to receive pin 34 for freedom of relative longitudinal movement therebetween. A clearance space provided by the space between pin 34 and the periphery of receptacle 35 is not critical, but will determine the permissible degree of pivotal and transverse movement between adjacent modules.

Figure 2:
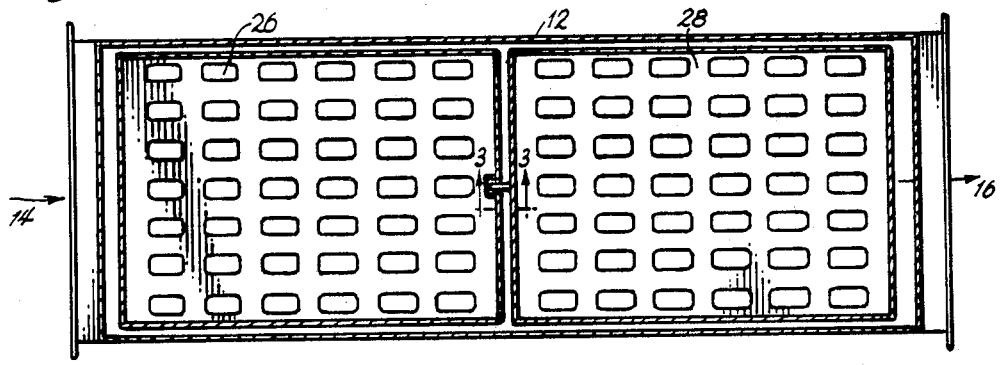
Figure 3:
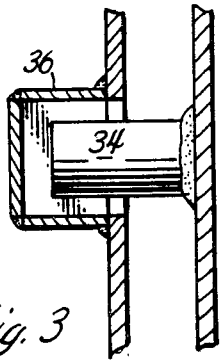

To enhance the guiding effect of the pin-receptacle arrangement 34–36, this arrangement is located near the central axis of the heat exchanger as seen in FIG. 2 whereby limited distortion or pivotal movement of adjacent modules may be readily accommodated along a substantially neutral axis, but relative vertical movement of adjacent modules is limited by the clearance space between the pin 34 and its receptacle 36.

Thus, adjacent modules will maintain alignment so that flow therethrough is not restricted by adjacent modules moving out of alignment, nor will bolts or weldments or other structure joining adjacent modules by cracked or broken when a thermal difference occurs so there will be no loss of integrity of the heat exchanger caused by differential expansion.

I claim:

1. A recuperative heat exchanger comprising:

a. a housing having an inlet at one end thereof and an outlet at the opposite end thereof for passing a first fluid therethrough and having an inlet port and an outlet port in an adacent wall thereof for respectively receiving and discharging a second fluid;

b. a plurality of heat exchanger modules disposed within the housing in laterally adjacent spaced relationship intermediate the inlet and outlet to the housing for the first fluid and interconnected in fluid communication to form a serpentine flow path, said modules each comprising a pair of spaced apart tube sheets with aligned apertures therein and a multiplicity of tube-like elements extending between the aligned apertures in said spaced tube sheets for directing the second fluid therethrough;

c. first flexible bellow means connecting a tube sheet at one end of the laterally outward module at one extremity of said plurality of laterally adjacent modules to the housing in fluid communication with the inlet port for the second fluid;

d. second flexible bellow means connecting a tube sheet at one end of the laterally outward module at the opposite extremity of said plurality of laterally adjacent modules to the housing in fluid communication with the outlet port for the second fluid;

e. header means for enclosing together the remaining ends of adjacent modules so as to interconnect the modules thereby providing a serpentine flow path therethrough for directing the second fluid from the inlet port therefor to the outlet port therefor in heat exchange relationship with the first fluid passing through the housing;

f. means for fixedly connecting together the adjacent tube sheets enclosed within said header means; and g. guide means extending horizontally between laterally adjacent modules at the ends thereof opposite said header means, said guide means adapted to permit limited pivotal movement between adjacent modules about a longitudinal axis through said horizontally extending guide means.

2. Apparatus as defined in claim 1 wherein the guide means comprises a horizontal pin extending outward from a side of one module toward the module adjacent thereto, and an apertured fitting on the adjacent module adapted to receive the horizontally extending pin.

3. Apparatus as defined in claim 2 wherein said pin extends horizontally outward from the central axis of a module to permit relative pivotal movement of the adjacent modules about the longitudinal axis of the horizontal pin.

4. Apparatus as defined in claim 3 wherein the horizontal pin fits into the apertured fitting with a close clearance therebetween, said clearance defining relative movement between adjacent modules.

* * * * *